United States Patent [19]

Barlass

[11] 4,412,783

[45] Nov. 1, 1983

[54] CENTRIFUGAL FAN WHEEL WITH CHANGEABLE PITCH BLADES

[75] Inventor: John W. Barlass, Janesville, Wis.

[73] Assignee: Thermo King Corporation, Minneapolis, Minn.

[21] Appl. No.: 309,860

[22] Filed: Oct. 8, 1981

[51] Int. Cl.[3] ..... F01D 5/22

[52] U.S. Cl. ..... 416/186 A; 416/147; 415/129

[58] Field of Search ..... 416/167, 186 A, 246; 415/129

[56] References Cited

U.S. PATENT DOCUMENTS

| | | | |
|---|---|---|---|
| 96,168 | 10/1869 | Tuttle | 415/129 |
| 683,935 | 10/1901 | Hensel | 415/129 X |
| 962,345 | 6/1910 | Hayner et al. | 415/129 |
| 1,067,385 | 7/1913 | Taylor | 416/167 |
| 1,283,908 | 11/1918 | Ripczinske | 416/167 |
| 1,309,005 | 7/1919 | Weatherly | 416/167 |
| 1,368,808 | 2/1921 | Koenig | 416/167 X |
| 1,820,467 | 8/1931 | Liska | 415/129 |
| 4,303,375 | 12/1981 | Foglesong et al. | 416/167 |

*Primary Examiner*—Philip R. Coe
*Assistant Examiner*—Frankie L. Stinson
*Attorney, Agent, or Firm*—E. C. Arenz

[57] ABSTRACT

A centrifugal fan wheel is provided with blades 10 which may have their pitch changed through circumferential movement of a ring 30 tied to an outer tube 28 encompassing a drive shaft 24 and capable of having its rotative position relative thereto changed, through the axial movement of a control rod 38 to which is attached a pin 44 extending into the control rod through a diagonal slot 42 in the outer tube and an axial slot 40 in the drive shaft. In a further embodiment an inlet vane 50 has its angle changed through its pivotal relation that one edge of the vane with a slot 60 in the outer tube, so that both blade 10 pitch and vane 50 angle are concurrently changeable.

4 Claims, 5 Drawing Figures

CENTRIFUGAL FAN WHEEL WITH CHANGEABLE PITCH BLADES

BACKGROUND OF THE INVENTION

This invention pertains to the art of centrifugal fan wheels.

It is well-known in the fan art that centrifugal fan wheels which have blade designs of different types each have their own advantages and disadvantages with respect to the wheels having other types of blade design. Some of the characteristics which vary with blade design include pressure, horsepower, efficiency, noise level, and air delivery rates.

The types of standard centrifugal fan wheels are classified as straight blade, forward curved blade, backward curved blade, radial tip blade, and backward flat blade. Each of these have different characteristics at different air delivery rates which are well-known and have their own characteristic curves.

In some situations it may be desirable to have a single wheel which is adapted to partake of the characteristics of several of the different types of wheels.

It is an aim of my invention to provide a centrifugal fan wheel of a construction which is adapted to have the pitch of its blades changed in order to gain control of airflow substantially independently of the fan speed.

SUMMARY OF THE INVENTION

In accordance with the general concept of the invention, a centrifugal fan wheel is provided in which the blades are secured at the opposite ends of their radially outer edges to outer peripheral ring means, the drive shaft is encompassed by an outer tube which is in rotatable relation thereto, openwork grid means or a spoke arrangement fixedly connected to the outer tube for rotation therewith has an outer peripheral portion engaging the radially inner portions of the blades for shifting the inner portions in a circumferential direction to vary the pitch of the blades in accordance with the relative rotative position of the outer tube to the drive shaft, and means are provided for changing the rotative relationship of the outer tube and the drive shaft to accordingly change the pitch of the blades. In accordance with an additional embodiment of the invention, the wheel is provided with a series of generally radially extending blades or vanes in the inlet area of the wheel, with the blades being pivotally movable to different angles in accordance with the relative positioning of the outer tube and the drive shaft.

DESCRIPTION OF THE PREFERRED EMBODIMENTS

Figure 1:
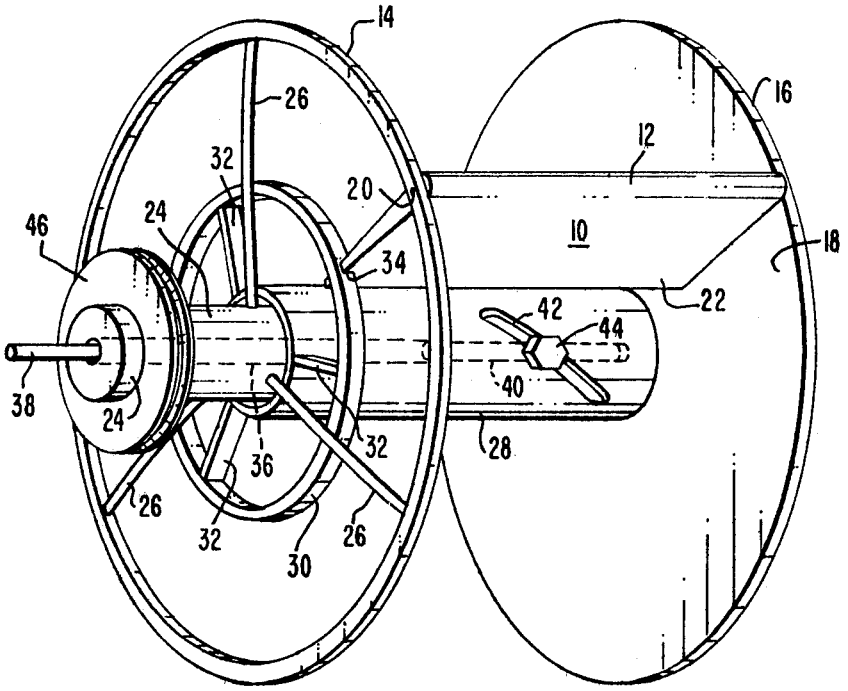
FIG. 1 is a fragmentary isometric view of a part of a fan wheel illustrating the concept of the invention.

Since the precise form and structure of the elements which comprise a centrifugal fan wheel which carries out the concept of the invention may take various forms, the wheels in the drawing are schematically illustrated. It is apparent that in the actual construction of a fan wheel according to the invention various of the parts may differ significantly from the manner in which they are illustrated in the drawings.

The wheel in FIG. 1 is shown with a single blade 10 which, at the opposite ends of its radially outer edge 12, is secured to the peripheral ring portions 14 and 16 of the elements which define the axial ends of the wheel. In a single width centrifugal fan wheel, the peripheral ring portion 16 will typically be the peripheral outer portion of the backplate 18 of the wheel. The means of securement illustrated at the end of the blade 10 closest to the viewer is that of a pivot pin 20, the same being provided at the opposite end of the blade as well. In another embodiment of an arrangement within the contemplation of the invention, the blade would be fixed at its ends to the rings 14 and 16 without being able to be pivoted, but the blade material would be of a flexible character so that upon circumferential movement of the radially inner edge 22 of the blade, the blade would flex to obtain the change in pitch and character of the wheel.

Both the opposite end rings 14 and 16 are secured for rotation with the shaft 24, the near end ring 14 in FIG. 1 being connected to the shaft by the radially extending spokes 26, and the far end ring 16 being connected to the shaft through the connection of the backplate 18 to the shaft. An outer tube 28 encompasses the driving shaft in rotatable relation therewith. A circular openwork grid comprising a slotted ring 30 and radial spokes 32 is fixedly connected to the outer tube 28 for rotation therewith through the securement of the inner ends of the spokes 32 to the outer tube. The ring or outer peripheral portion of the openwork grid is provided with a series of slots 34, the number corresponding to the number of blades, with the inner radial portions of the ends of the blades fitting in the slots for shifting the inner portion of the blades in a circumferential direction to accordingly vary the pitch of the blades in accordance with the extent of the rotative position of the outer tube 28 relative to the shaft 24. In other words, since the outer rings 14 and 16 to which the outer radial edges of the blade are secured have a fixed circumferential position relative to the drive shaft 24, and since the inner radial portions of the blades are subject to being shifted circumferentially in accordance with the rotative position of the outer tube 28, the change in pitch of the blades is determined by the change in relative rotative position of the drive shaft and outer tube 28. While the engagement of the ring 30 to the radially inner portion of the blades 10 is illustrated in FIG. 1 as being accomplished through the use of slots 34, it will be appreciated that other structural arrangements may be used, such as the provision of a solid ring with axially extending pins capturing the inner radial portion of the blade therebetween.

In accordance with the invention, means are also provided to effect the change in the rotative relationship of the outer tube 28 to the drive shaft 24. In the illustrated embodiment the drive shaft 24 is provided with an axial bore 36 into which a control rod 38 is received. The drive shaft is provided with an axially extending slot 40 and the outer tube 28 has a diagonally extending slot 42 with their locations along the axial length of the shafts and tubes being generally in registry. A radially extending pin such as a bolt 44 extends through both slots with its inner end fixedly secured to the control rod 38.

With this arrangement, if the control rod is moved inwardly through the shaft, the outer tube will be rotated in a counterclockwise direction as viewed in FIG. 1 relative to the shaft 24. Movement of the rod 38 outwardly will result in circumferential movement of the outer tube 28 in the opposite direction. It is by this arrangement that control of the relative rotative positions of the shaft and outer tube is effected and accordingly the particular pitch of the blades.

Rotation of the shaft may be effected in any conventional manner such as by providing a pulley on the drive shaft, a part 46 of the pulley being shown in FIG. 1.

Figure 2A:
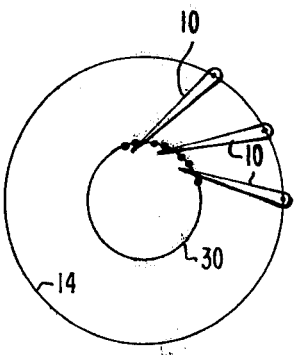
FIGS. 2A, 2B and 2C are three schematic views in the nature of end views and showing a series of blades in three different positions.
Figure 2B:
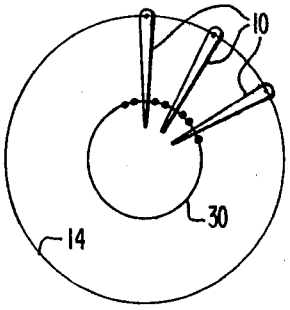
Figure 2C:
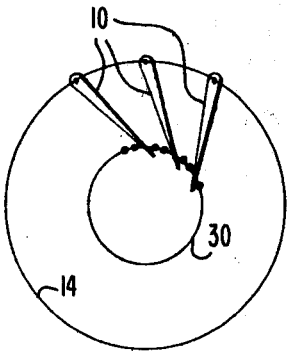

In FIG. 2 various pitch angles of a series of blades is illustrated. It may be assumed for purposes of explanation that in each of the three views the wheel is rotating in a clockwise direction. Thus in FIG. 2A the blades are generally forwardly inclined and the wheel would partake of characteristics similar to a forwardly curved blade design wheel. In FIG. 2B the blades are disposed radially and the wheel would accordingly have similar characteristics, and in FIG. 2C the blades are inclined backwardly and accordingly would have the general characteristics of such a wheel.

Figure 3:
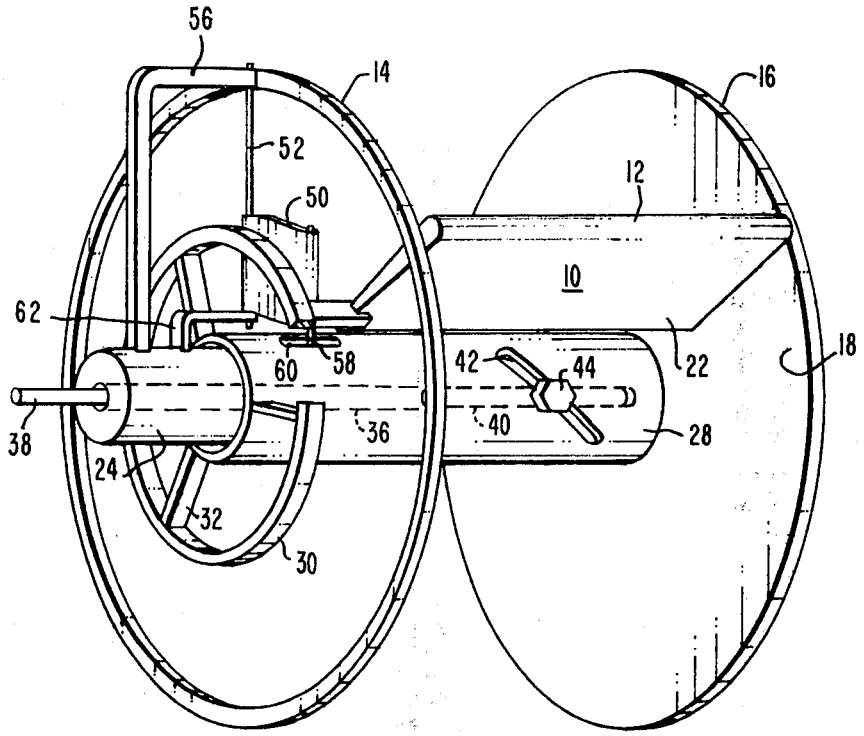
FIG. 3 is a fragmentary isometric view similar to FIG. 1 but showing an arrangement in which fan inlet vanes are also provided.

In FIG. 3 a centrifugal wheel of the general type embodying the invention explained in connection with FIG. 1 is additionally provided with a movable inlet vane arrangement. Those parts illustrated in FIG. 3 which are the same as in FIG. 1, or which provide a similar function to those parts in FIG. 1, are given the same numerals as in FIG. 1. Only a single movable inlet vane is illustrated since an explanation of its operation should make it apparent how a series of similar vanes arranged radially around the inlet area of the wheel would function.

In the arrangement shown, the vane 50 is disposed in the circumferential area defined generally at its radially inner part by the exterior of the outer tube 28, and defined at its radially outer part by the inner edge portion 22 of the blade 10. The vane 50 is pivotally secured at its radially outer edge by a shaft 52 which extends radially outwardly and is pivotally captured at its radially outer end by the end ring structure 14 or structure of the spoke 56 tying the outer ring portion 14 to the shaft 24 in a fixed relation. The radially inner edge portion of the vane 50 has a pivot pin 58 which projects down into an axially extending slot 60 in which it is free to move when the outer tube 28 has its rotative position relative to the shaft 24 changed. The edge of the blade 50 which is in line with the shaft 52 is pivotally supported at its lower end by an angle bracket 62 which has its one end fixed to the drive shaft 24 and its other end providing the pivot connection to the vane 50.

With the described arrangement it will be apparent that as the rotative position of the outer tube 28 relative to the drive shaft 24 is changed, the centrifugal fan wheel blades 10 will be accordingly changed, and the angular positions of the vanes 50 in the inlet to the wheel. Thus, control of airflow can be achieved through the joint effect of changing the pitch of the blades 10 and the angle of the vanes 50.

It is considered that an air-moving centrifugal fan wheel embodying the concepts of the invention may find service in various applications, one particular application in which it is believed the invention would be quite useful is in connection with the centrifugal fan wheels used on transport refrigeration apparatus in which it is common to drive a fan at more than one speed because of the change in speed of the prime mover for the refrigeration system.

While not shown, it will be appreciated that the vanes may also be arranged in a way to severely restrict or effectively cut off air flow. This could be done independently of the centrifugal blade arrangement, and could find applicability in connection with stopping air flow during a defrost cycle of a transport refrigeration unit where the wheel is belt driven.

I claim:

1. In an air-moving centrifugal fan wheel having an air inlet area including a drive shaft, opposed wheel end means including outer peripheral ring means, as related to said shaft; and connected to the shaft for driving movement, and a series of fan blades spaced around the wheel, each of said blades having opposite ends, a radially outer edge and a radially inner edge portion, an arrangement for varying the pitch of the blades comprising:

means securing said opposite ends of said radially outer edges of said blades to said outer peripheral ring means;

an outer tube encompassing said drive shaft in rotatable relation therewith;

openwork grid means fixedly connected to said outer tube for rotation therewith and having an outer peripheral portion engaging said radially inner portions of said blades for shifting said inner portions in one or another circumferential direction to vary the pitch of said blades in accordance with rotation of said outer tube relative to said drive shaft; and means for changing the rotative relationship of said outer tube and said drive shaft to accordingly change the pitch of said blades.

2. An arrangement according to claim 1 including:

a series of generally radially extending vanes arranged in said inlet area of said wheel, said vanes being pivotally movable to different angles in accordance with the rotative relationship of said outer tube to said drive shaft.

3. An arrangement according to claim 1 wherein:

said drive shaft includes an axial bore therein and an axial slot;

said outer tube includes a diagonal slot therein in general registry with said axial slot of said drive shaft; and axially movable control rod means in said axial bore of said drive shaft, said control rod means including lever means fixed thereto and projecting out through said axial slot and said diagonal slot so that axial movement of said control rod effects said change in relative rotative position of said outer tube to said drive shaft.

4. An arrangement according to claim 2 wherein:

said vane means include one radially extending edge which is pivotally supported in fixed relation to said drive shaft and said outer peripheral ring means, the other radially extending edge including means in engaging relation with axially extending slot means in said outer tube.

* * * * *